US005912975A

United States Patent [19]

Schott

[11] Patent Number: 5,912,975

[45] Date of Patent: Jun. 15, 1999

[54] METHOD AND CIRCUIT FOR CREATING PHANTOM SOURCES USING PHASE SHIFTING CIRCUITRY

[75] Inventor: Wayne Milton Schott, Seymour, Tenn.

[73] Assignee: Philips Electronics North America Corp, New York, N.Y.

[21] Appl. No.: 08/800,634

[22] Filed: Feb. 14, 1997

Related U.S. Application Data

[63] Continuation-in-part of application No. 08/497,316, Jul. 3, 1995.

[51] Int. Cl.[6] ..... H04R 5/00

[52] U.S. Cl. ..... 381/1; 381/17; 381/28; 381/97

[58] Field of Search ..... 381/1, 2, 17, 23, 381/27–28, 63, 97–98

[56] References Cited

U.S. PATENT DOCUMENTS

| | | | |
|---|---|---|---|
| Re. 29,171 | 4/1977 | Takahashi | 381/21 |
| 4,191,852 | 3/1980 | Nishikawa | 381/1 |
| 4,218,585 | 8/1980 | Carver | 381/97 |
| 4,817,162 | 3/1989 | Kihara | 381/1 |
| 4,873,722 | 10/1989 | Tominari | 381/17 |
| 4,980,914 | 12/1990 | Kunugi et al. | 381/1 |
| 5,119,420 | 6/1992 | Kato et al. | 381/1 |
| 5,121,433 | 6/1992 | Kendall et al. | 381/1 |
| 5,230,022 | 7/1993 | Sakata | 381/97 |
| 5,339,363 | 8/1994 | Fosgate | 381/97 |
| 5,420,929 | 5/1995 | Geddes et al. | 381/1 |
| 5,692,050 | 11/1997 | Hawks | 381/1 |
| 5,742,687 | 4/1998 | Aarts | 381/27 |
| 5,761,313 | 6/1998 | Schott | 381/1 |
| 5,809,149 | 9/1998 | Cashion et al. | 381/17 |

FOREIGN PATENT DOCUMENTS

| | | | |
|---|---|---|---|
| 56-111400 | 9/1981 | Japan | 381/1 |
| 3-106200 | 5/1991 | Japan | 381/1 |

*Primary Examiner*—Curtis A. Kuntz
*Assistant Examiner*—Xu Mei
*Attorney, Agent, or Firm*—Michael E. Belk

[57] ABSTRACT

In portable stereo radio receivers and television receivers, the loudspeakers therein may be separated only by a limited amount. This severely restricts the stereo image created by the loudspeakers. A circuit arrangement for creating an expanded stereo image may be incorporated in such receivers. This circuit arrangement includes, for each stereo channel, a first and a second all-pass 0°–180° phase shifter, wherein the first phase shifter shifts the input signal by 90° at a frequency of 10 KHz, while the second phase shifter shifts the input signal by 90° at a frequency of 100 Hz. The output from the first phase shifter in the left channel is combined with the output from the second phase shifter in the right channel to form the left channel output signal. Similarly, the output from the first phase shifter in the right channel is combined with the output from the second phase shifter in the left channel to form the right channel output signal.

8 Claims, 5 Drawing Sheets

METHOD AND CIRCUIT FOR CREATING PHANTOM SOURCES USING PHASE SHIFTING CIRCUITRY

CROSS-REFERENCE TO RELATED APPLICATION

This is a continuation-in-part application to Applicant's U.S. patent application Ser. No. 08/497,316, filed Jul. 3, 1995.

BACKGROUND OF THE INVENTION

1. Field of the Invention

The subject invention relates to a signal processing circuit for enhancing a stereo image that corresponds to a stereo audio signal.

2. Description of the Related Art

In conventional stereo systems, the amplifying circuits amplify the left and right channel signals and pass these amplified signals to a left and right channel loudspeakers. This is done in an attempt to simulate the experience of a live performance in which the reproduced sounds emanate from different locations. Since the advent of stereo systems, there has been continual development of systems which more closely simulate this experience of a live performance. For example, in the early to mid 1970's, four-channel stereo systems were developed which included two front left and right channel loudspeakers and two rear left and right channel speakers. These systems attempted to recapture the information contained in signals reflected from the back of a room in which a live performance was being held. More recently, surround sound systems are currently on the market which, in effect, seek to accomplish the same effect.

A drawback of these systems is that there are four or more channels of signals being generated and a person must first purchase the additional loudspeakers and then solve the problem of locating the multiple loudspeakers for the system.

As an alternative to such a system, U.S. Pat. No. 4,748,669 to Klayman discloses a stereo enhancement system which simulates this wide dispersal of sound while only using the two stereo loudspeakers. This system, commonly known as the Sound Retrieval System, uses dynamic equalizers, which boost the signal level of quieter components in the audio spectrum relative to louder components, a spectrum analyzer and a feedback and reverberation control circuit to achieve the desired effect. However, as should be apparent, this system is relatively complex and costly to implement.

SUMMARY OF THE INVENTION

It is an object of the present invention to provide a circuit arrangement for enhancing the imaging of a stereo signal such that it seems much larger than the actual spacing between the stereo loudspeakers.

It is a further object of the invention to provide such a circuit arrangement that is relatively simple and inexpensive to implement.

The above objects are achieved in a circuit arrangement for creating phantom sources in a stereo signal, comprising a first input and a second input for receiving, respectively, a left channel input signal and a right channel input signal of an input stereo signal; first phase shifting means coupled to the first input for phase shifting the left channel input signal; second phase shifting means also coupled to the first input for phase shifting the left channel input signal; third phase shifting means coupled to the second input for phase shifting the right channel input signal; fourth phase shifting means also coupled to the second input for phase shifting the right channel signal; first summing means having a first input coupled to an output of the first phase shifting means, a second input coupled to an output of the third phase shifting means, and an output for providing a left channel output signal; and second summing means having a first input coupled to an output of the fourth phase shifting means, a second input coupled to an output of the second phase shifting means, and an output for providing a right channel output signal.

Applicant has found that in small portable stereo receivers and in television receivers, the spacing between the stereo loudspeakers is limited. When the circuit arrangement of the subject invention is incorporated in such receivers, the stereo image is greatly expanded, much beyond the limited placement of the stereo loudspeakers.

The traditional method of creating virtual or phantom sound sources beyond the physical boundaries of the stereo loudspeaker placement employs some method of putting out-of-phase (180°) cross-talk into the opposite loudspeaker. The problem associated with this method of expanding the stereo field is that it is extremely sensitive to listener positioning which has to be along the centerline between the two loudspeakers. When the listener is positioned away from the centerline, the expanded field collapses.

The subject invention not only widens the stereo presentation, but also widens the listening area in which the widened stereo effect is perceived. This is accomplished by limiting the phase-differential between the driven channel and the cross-talk channel to less than 180° over the audio frequency band.

In the circuit arrangement of the subject invention, one phase shifting network feeds the signal straight through to its corresponding channel, while the other network is cross-coupled to the opposite channel. The resulting signals are then summed in the two summing circuits.

In an embodiment of the invention, the circuit arrangement is characterized in that said first, second, third and fourth phase shifting means each comprises an all-pass 0°–180° phase shifter, wherein an amount that an input signal is phase shifted is dependent on the frequency of the input signal applied to the phase shifter.

The amount of phase spread between the driven channel and the cross-coupled channel may be adjusted by altering the parameter values of the all-pass phase shifting networks to either increase the differential toward 180° or to decrease the spread toward 0°.

In a preferred embodiment of the invention, the circuit arrangement is characterized in that said first and fourth phase shifting means each applies a phase shift of 90 degrees when an input signal applied thereto has a frequency of 10 KHz, and said second and third phase shifting means each applies a phase shift of 90 degrees when an input signal applied thereto has a frequency of 100 Hz.

The level difference between the driven channel and the cross-coupled signal may be adjusted to either widen the amount of stereo-spread or decrease the amount of spread.

In the preferred embodiment of the invention, said first and second summing means each applies a gain of 5 dB to the signal applied to the first input, and a gain of 0 dB to the signal applied to the second input.

BRIEF DESCRIPTION OF THE DRAWINGS

With the above and additional objects and advantages in mind as will hereinafter appear, the invention will be described with reference to the accompanying drawings, in which.

DESCRIPTION OF THE PREFERRED EMBODIMENTS

Figure 1:
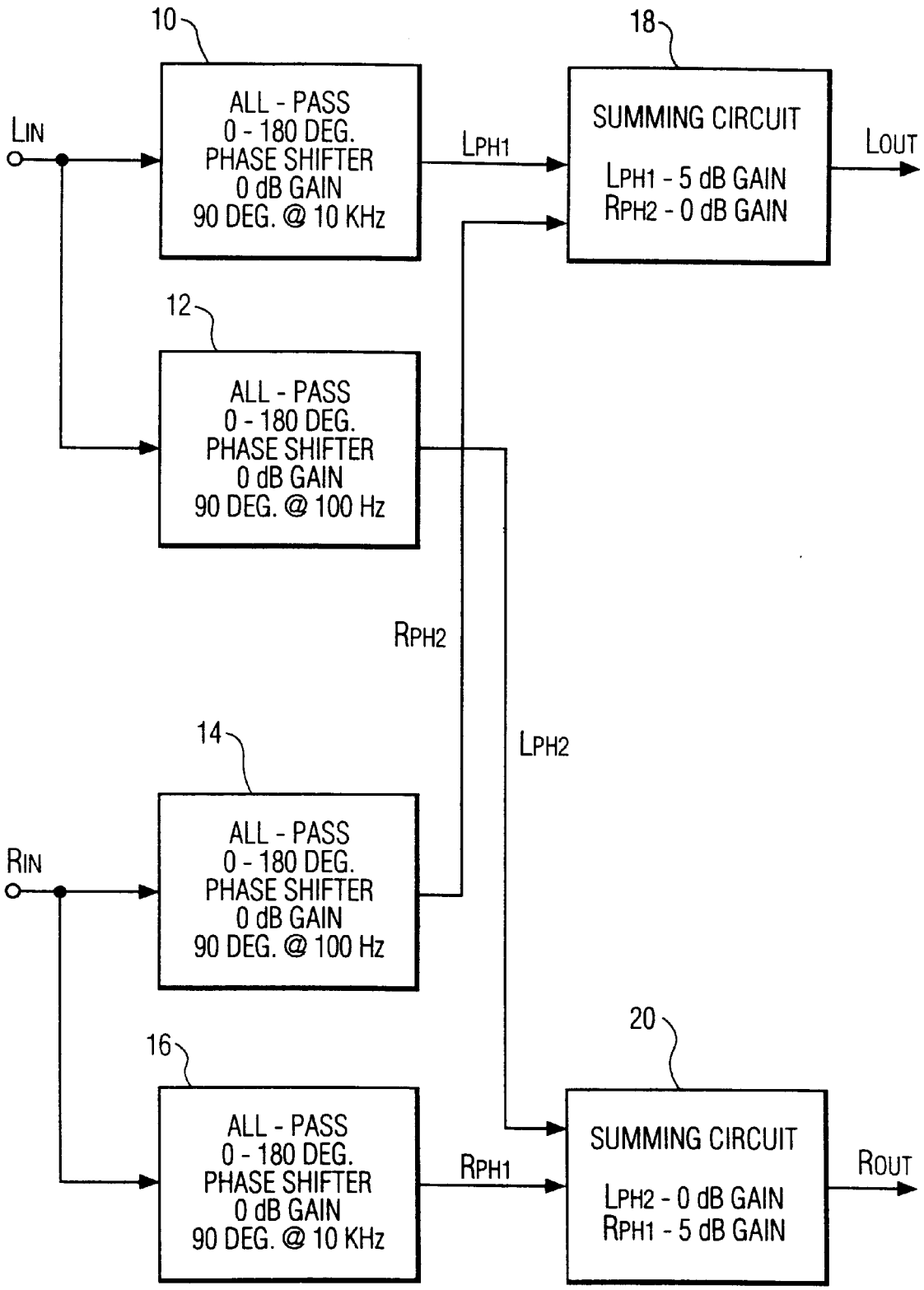
FIG. 1 is a block diagram of a circuit arrangement of the invention.

FIG. 1 shows a block diagram of a circuit arrangement of the invention. A left channel input signal is applied to an input $L_{IN}$ of the circuit arrangement and then to inputs of a first phase shifter 10 and a second phase shifter 12. A right channel input signal is applied to an input $R_{IN}$ of the circuit arrangement and then to inputs of a third phase shifter 14 and a fourth phase shifter 16. These phase shifters are all-pass, 0°–180°, phase shifting networks having a gain of 0 dB. In the case of the first and fourth phase shifters 10 and 16, the parameters thereof are adjusted so that an input signal applied thereto is phase shifted by 90° when the input signal has a frequency of 10 KHz. Similarly, in the case of the second and third phase shifters 12 and 14, the parameters thereof are adjusted so that an input signal applied thereto is phase shifted by 90° when the input signal has a frequency of 100 Hz.

An output (LPH1) from the first phase shifter 10 is applied to a first input of a first summing circuit 18, while an output (RPH2) from the third phase shifter 14 is applied to a second input of the first summing circuit 18. Similarly, an output (RPH1) from the fourth phase shifter 16 is applied to a first input of a second summing circuit 20, while an output (LPH2) from the second phase shifter 12 is applied to a second input of the second summing circuit 20.

Summing circuits 18 and 20 are similar in that signals applied to their first inputs are amplified at a gain of 5 dB, while signals applied to their second inputs are amplified at a gain of 0 dB.

The output from the first summing circuit forms the left channel output signal and is applied to the LOUT output of the circuit arrangement. Similarly, the output from the second summing circuit forms the right channel output signal and is applied to the ROUT output of the circuit arrangement.

Figure 2:
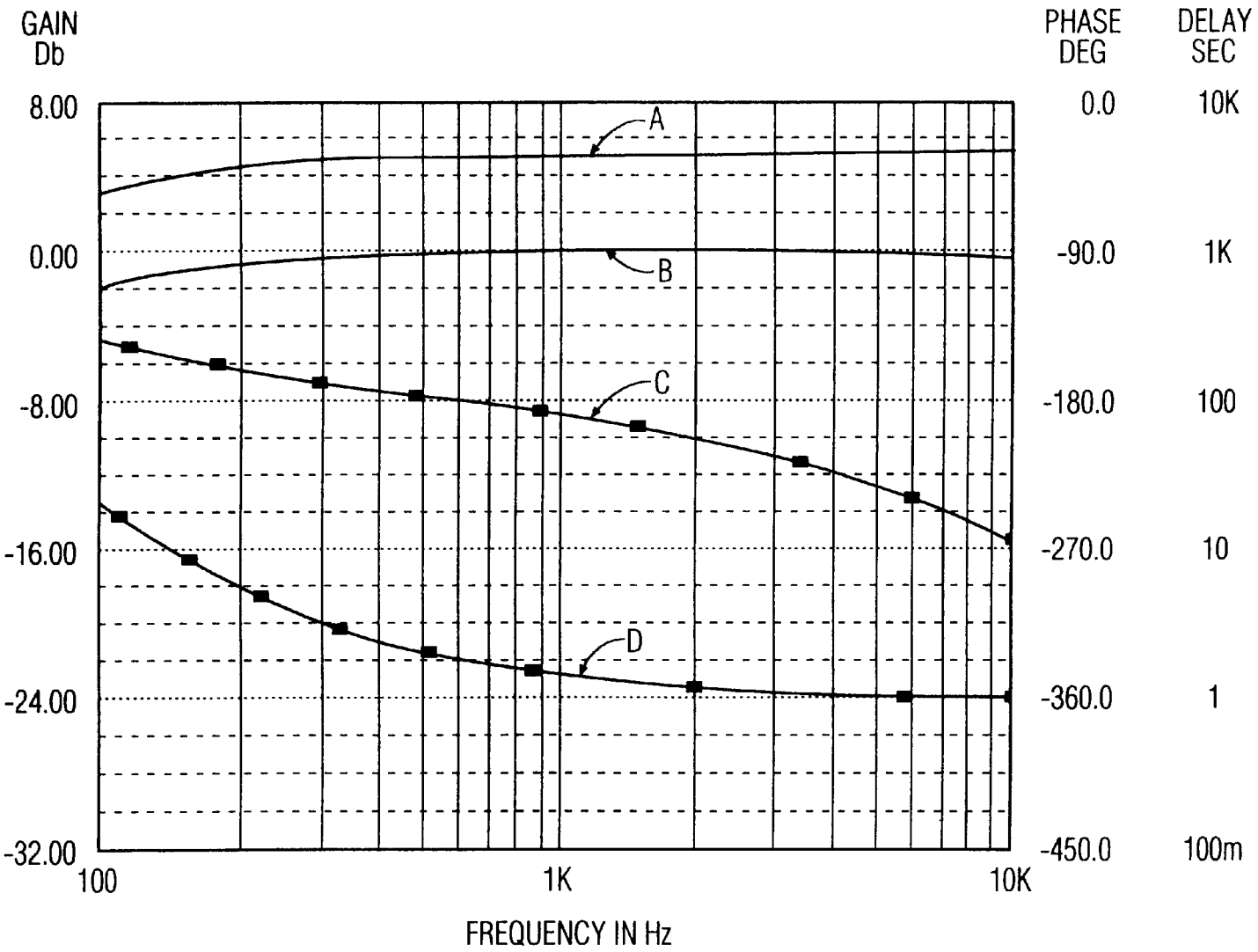
FIG. 2 shows a plot of the response curves of the driven channel and the cross-talk channel for the circuit arrangement of FIG. 1.

FIG. 2 shows a plot of the driven channel and cross-coupled channel amplitude response curves (A and B) with respect to frequency, and the driven channel and cross-coupled channel phase response curves (C and D) with respect to frequency. It should be noted that the amplitude difference between the driven channel and the cross-coupled channel is 5 dB. It should further be noted that across the frequency band, the phase difference between these two channels is always less than 180°.

Figure 3:
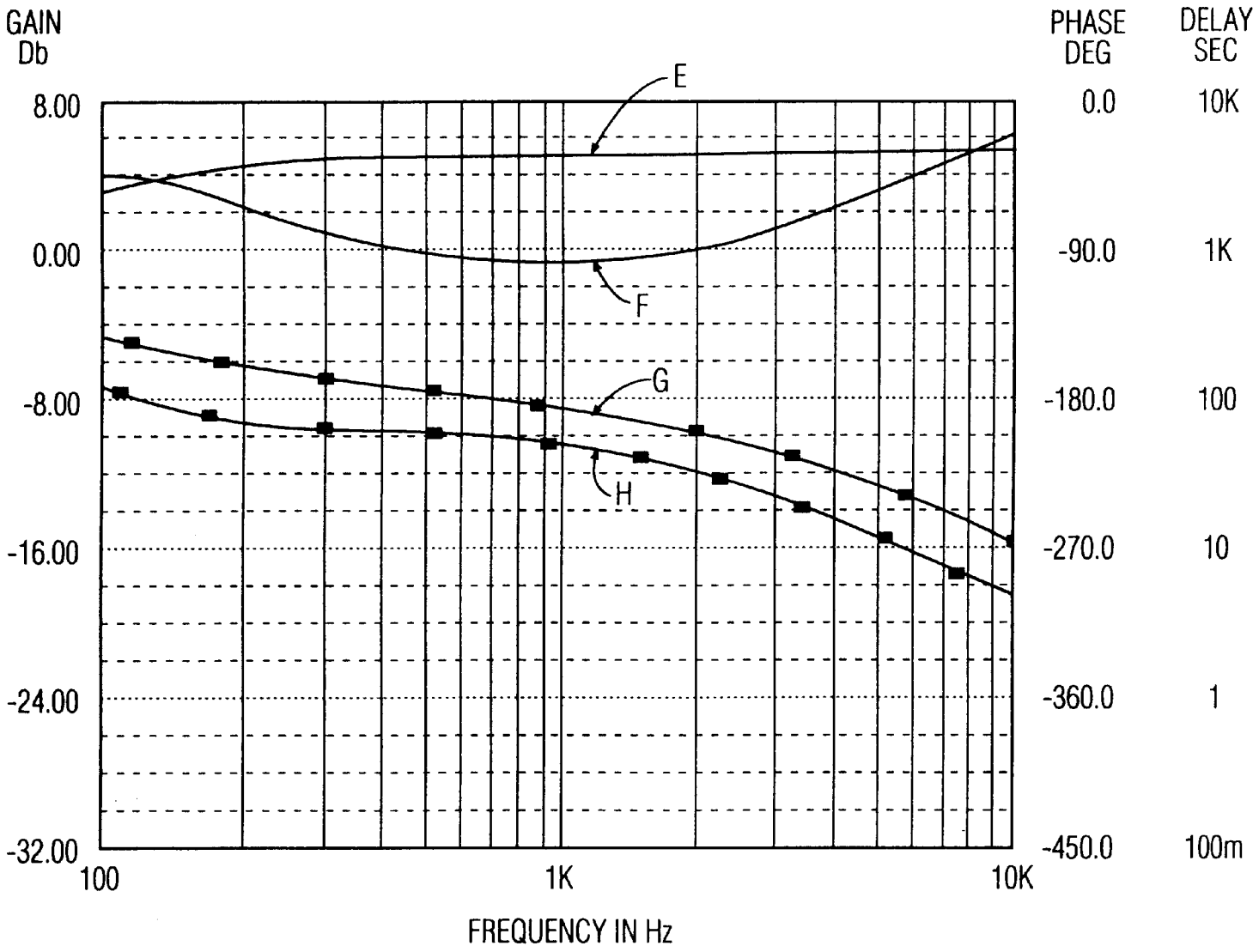
FIG. 3 shows a plot of the response curves of a single channel and the monaural signal for the circuit arrangement of FIG. 1.

FIG. 3 shows a plot of a single channel and monaural (L+R) amplitude response curves (E and F) and phase response curves (G and H) with respect to frequency.

Figure 5:
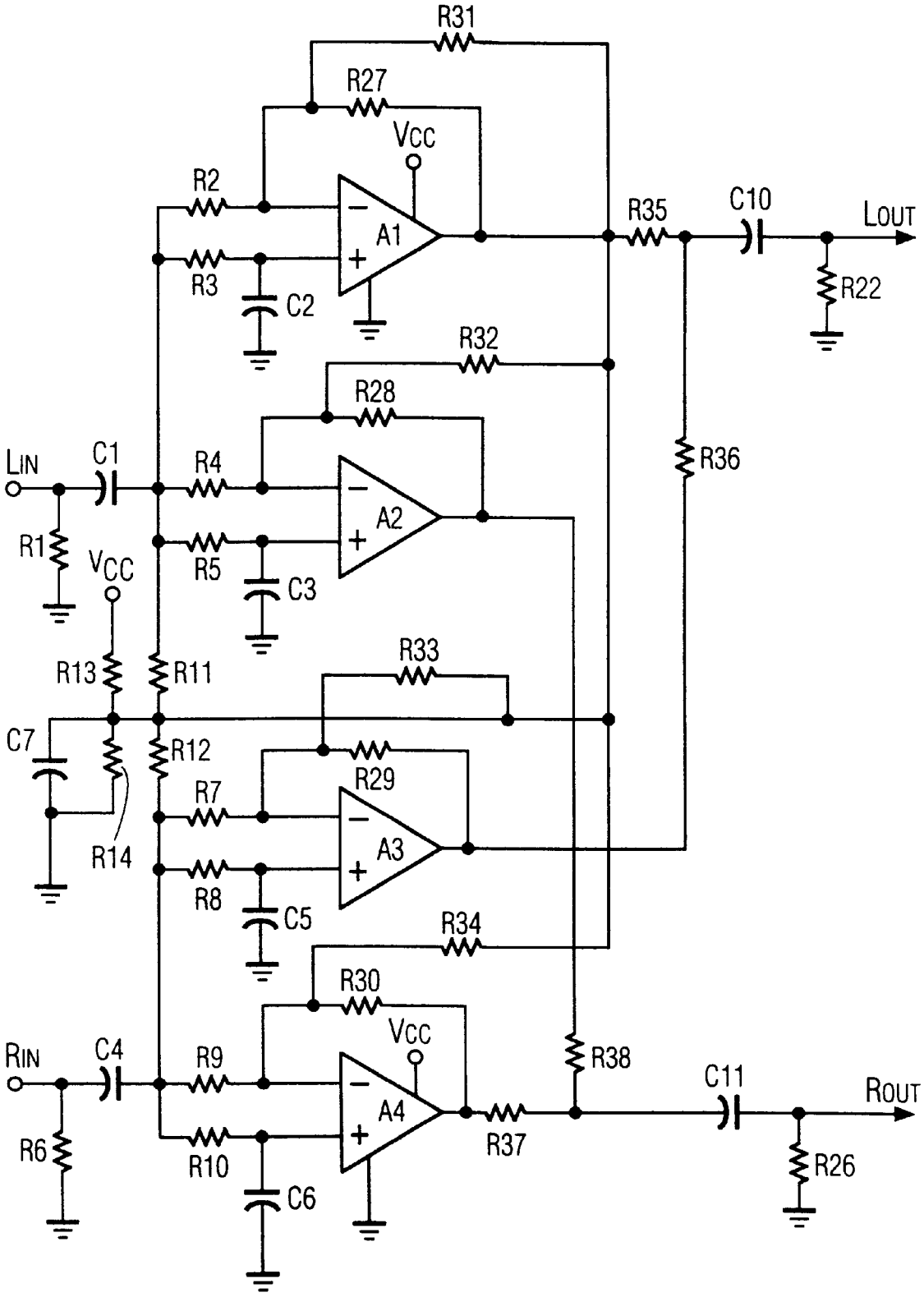
FIG. 5 is a schematic diagram of a modification of the schematic diagram of FIG. 4.

FIG. 5 is a schematic diagram of circuit arrangement for a practical embodiment of the invention. In particular, the left input $L_{IN}$ is connected to ground through a resistor R1, and to a first end of a capacitor C1. The second end of capacitor C1 is connected to the inverting and non-inverting inputs of a operational amplifier A1 via resistors R2 and R3, respectively, and to the inverting and non-inverting inputs of operational amplifier A2 via resistors R4 and R5, respectively. The non-inverting inputs of operational amplifiers A1 and A2 are also connected to ground through capacitors C2 and C3, respectively.

Similarly, the right input $R_{IN}$ is connected to ground through a resistor R6 and to a first end of a capacitor C4. A second end of capacitor C4 is connected to the inverting and non-inverting inputs of operational amplifier A3 via resistors R7 and R8, respectively, and to the inverting and non-inverting inputs of operational amplifier A4 via resistors R9 and R10, respectively. The non-inverting inputs of operational amplifiers A3 and A4 are also connected to ground through capacitors C5 and C6, respectively. The second ends of capacitors C1 and C4 are connected to each other through the series arrangement of two resistors R11 and R12. The junction between resistors R11 and R12 is connected to a d.c. voltage source Vcc via a resistor R13, and to ground via the parallel combination of a resistor R14 and a capacitor C7.

Operational amplifiers A1 and A4 both have supply terminals connected to ground and to the d.c. voltage source Vcc, respectively. The inverting inputs of operational amplifiers A1–A4 are connected, respectively, to the outputs thereof by respective resistors R15–R18. Arranged as such, the operational amplifiers A1–A4 form the phase shifters 10–16 of FIG. 1.

The output of operational amplifier A1 is connected through a resistor R19 to the inverting input of summing amplifier A5, whose non-inverting input is connected to the junction between resistors R11 and R12. The output of operational amplifier A3 is also connected, through a resistor R20, to the inverting input of summing amplifier A5. A resistor R21 connects the inverting input of summing amplifier A5 to its output, which is connected to ground through the series combination of a capacitor C8 and a resistor R22. The junction between capacitor C8 and resistor R22 is connected to the output terminal LOUT.

Similarly, the output of operational amplifier A4 is connected through a resistor R23 to the inverting input of summing amplifier A6, whose non-inverting input is connected to the junction between resistors R11 and R12. The output of operational amplifier A2 is also connected, through resistor R24, to the inverting input of summing amplifier A6. A resistor R25 connects the inverting input of summing amplifier A6 to its output, which is connected to ground through the series arrangement of a capacitor C9 and a resistor R26. The junction between capacitor C9 and resistor R26 is connected to the output terminal ROUT.

In an exemplary embodiment, the values of the above components are as follows:

| RESISTORS | | |
|---|---|---|
| R1, R6 | 100 | KΩ |
| R2, R4, R7, R9, R15, R16, R17, R18 | 47 | KΩ |
| R3, R5, R8, R10, R19, R22, R23, R26 | 10 | KΩ |
| R11, R12 | 22 | KΩ |
| R13, R14 | 1 | KΩ |
| R20, R21, R24, R25 | 18 | KΩ |

-continued

| CAPACITORS | |
|---|---|
| C1, C4 | 5 μF |
| C2, C6 | 1.5 nF |
| C3, C5 | 0.1 μF |
| C7 | 100 μF |
| C8, C9 | 1.0 μF |

The operational amplifiers Al, A3, A5 and A6 are each type LF347, while the operational amplifiers A2 and A4 are each type LM833.

Figure 4:
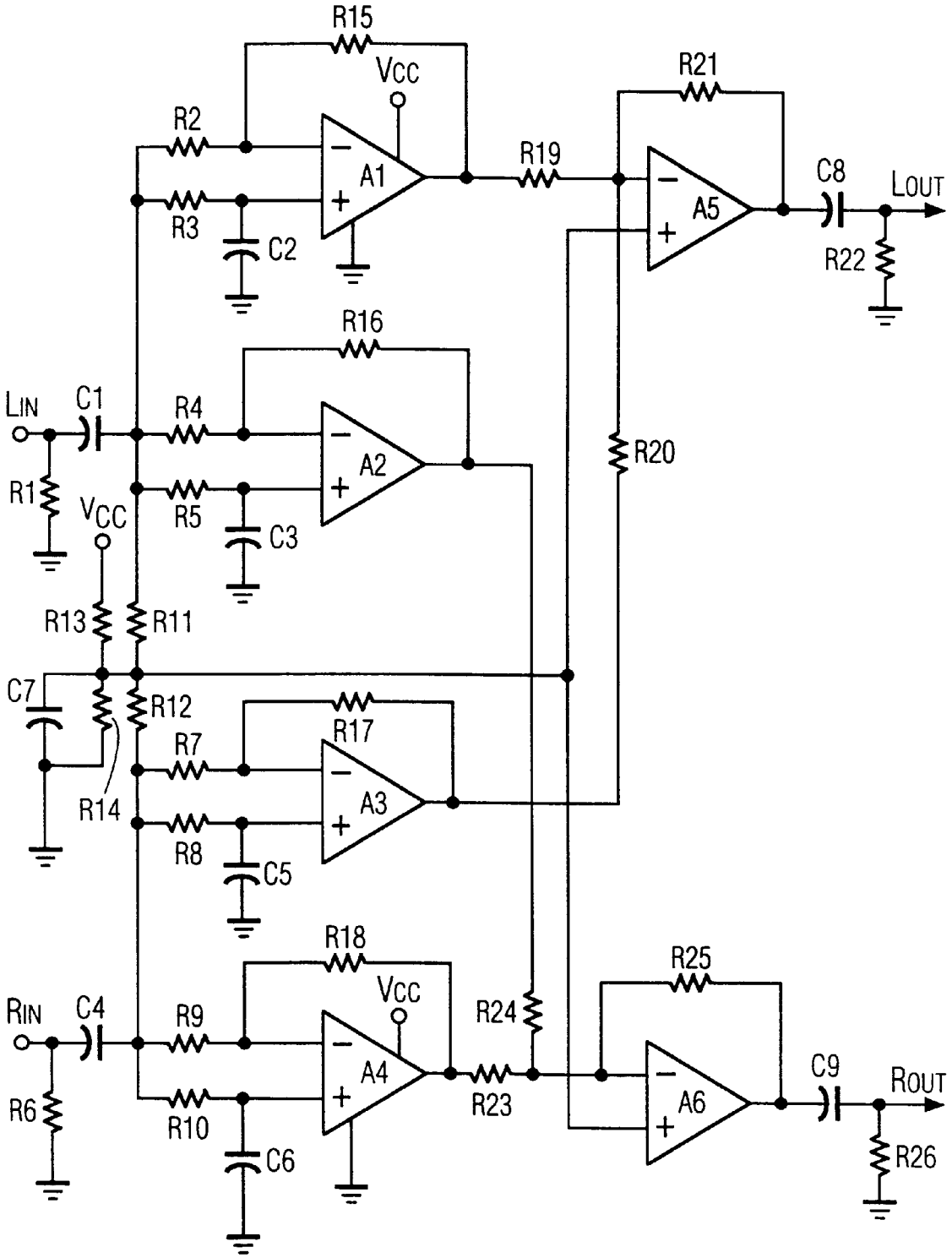
FIG. 4 is a schematic diagram of the circuit arrangement of FIG. 1.

Applicant has found that gain increasing feature of the summing circuits 18 and 20 of FIG. 1 may be incorporated into the phase shifters and, as such, the operational amplifiers A5 and A6 of FIG. 4 may be eliminated. FIG. 5 shows this embodiment identical elements have retained their designation. In particular, feedback resistors R15–R18 are replaced by resistors R27–R30. The junction between resistors R11 and R12 is now connected to the inverting inputs of operational amplifiers A1–A4 via resistors R31–R34, respectively. The output from operational amplifier A1 is now connected to ground through the series combination of resistor R35, capacitor C10 and resistor R22. The output from operational amplifier A3 is connected to the junction between resistor R35 and capacitor C10 through a resistor R36. The junction between capacitor C10 and resistor R22 is connected to the output terminal LOUT Similarly, The output from operational amplifier A4 is connected to ground through the series combination of resistor R37, capacitor C11 and resistor R26. The output from operational amplifier A2 is connected to the junction between resistor R37 and capacitor C11 through a resistor R38. The junction between capacitor C11 and resistor R26 is connected to the output terminal ROUT.

In an exemplary embodiment, the values of the above components different from those in FIG. 4 are as follows:

| RESISTORS | |
|---|---|
| R27, R28, R29, R30 | 150 KΩ |
| R31, R32, R33, R34 | 75 KΩ |
| R35, R37 | 1 KΩ |
| R36, R38 | 1.8 KΩ |
| **CAPACITORS** | |
| C10, C11 | 0.22 μF |

Numerous alterations and modifications of the structure herein disclosed will present themselves to those skilled in the art. However, it is to be understood that the above described embodiment is for purposes of illustration only and not to be construed as a limitation of the invention. All such modifications which do not depart from the spirit of the invention are intended to be included within the scope of the appended claims.

What is claimed is:

1. A circuit arrangement, comprising:

a first input and a second input for receiving, respectively, a left channel input signal and a right channel input signal of an input stereo signal;

first phase shifting means coupled to the first input for phase shifting the left channel input signal;

second phase shifting means also coupled to the first input for phase shifting the left channel input signal;

third phase shifting means coupled to the second input for phase shifting the right channel input signal;

fourth phase shifting means also coupled to the second input for phase shifting the right channel signal;

first summing means having a first input coupled to an output of the first phase shifting means, a second input coupled to an output of the third phase shifting means, and an output for providing a left channel output signal; and second summing means having a first input coupled to an output of the fourth phase shifting means, a second input coupled to an output of the second phase shifting means, and an output for providing a right channel output signal;

and wherein for the first and second summing means, a different gain is applied to each different input of the first and second summing means.

2. The arrangement of claim 1, wherein the first, second, third and fourth phase shifting means each comprises an all-pass 0°–180° phase shifter, wherein an amount that an input signal is phase shifted is dependent on the frequency of the input signal applied to the phase shifter.

3. The arrangement of claim 1, wherein the first and second summing means each applies a gain of 5 dB to the signal applied to the first input, and a gain of 0 dB to the signal applied to the second input.

4. A circuit arrangement, comprising:

a first input and a second input for receiving respectively, a left channel input signal and a right channel input signal of an input stereo signal;

first phase shifting means coupled to the first input for phase shifting the left channel input signal;

second phase shifting means also coupled to the first input for phase shifting the left channel input signal;

third phase shifting means coupled to the second input for phase shifting the right channel input signal;

fourth phase shifting means also coupled to the second input for phase shifting the right channel signal;

first summing means having a first input coupled to an output of the first phase shifting means, a second input coupled to an output of the third phase shifting means, and an output for providing a left channel output signal; and second summing means having a first input coupled to an output of the fourth phase shifting means, a second input coupled to an output of the second phase shifting means, and an output for providing a right channel output signal.

and wherein:

the first, second, third and fourth phase shifting means each comprises an all-pass 0°–180° phase shifter:

an amount that an input signal is phase shifted is dependent on the frequency of the input signal applied to the phase shifter: and the first and fourth phase shifting means each applies a phase shift of 90 degrees when an input signal applied thereto has a frequency of 10 KHz.

5. The circuit arrangement of claim 3, wherein the first and second summing means each applies a gain of 5 dB to the signal applied to the first input, and a gain of 0 db to the signal applied to the second input.

6. A circuit arrangement, comprising:

a first input and a second input for receiving. respectively, a left channel input signal and a right channel input signal of an input stereo signal;

first phase shifting means coupled to the first input for phase shifting the left channel input signal;

second phase shifting means also coupled to the first input for phase shifting the left channel input signal;

third phase shifting means coupled to the second input for phase shifting the right channel input signal;

fourth phase shifting means also coupled to the second input for phase shifting the right channel signal;

first summing means having a first input coupled to an output of the first phase shifting means, a second input coupled to an output of the third phase shifting means, and an output for providing a left channel output signal; and second summing means having a first input coupled to an output of the fourth phase shifting means, a second input coupled to an output of the second phase shifting means, and an output for providing a right channel output signal, and wherein:

the first, second, third and fourth phase shifting means each comprises an all-pass 0°–180° phase shifter;

an amount that an input signal is phase shifted is dependent on the frequency of the input signal applied to the phase shifter; and the second and third phase shifting means each applies a phase shift of 90 degrees when an input signal applied thereto has a frequency of 100 Hz.

7. The arrangement of claim 4, wherein the first and second summing means each applies a gain of 5 dB to the signal applied to the first input, and a gain of 0 db to the signal applied to the second input.

8. A circuit arrangement, comprising:

a first input and a second input for receiving, respectively, a left channel input signal and a right channel input signal of an input stereo signal;

first phase shifting means coupled to the first input for phase shifting the left channel input signal;

second phase shifting means also coupled to the first input for phase shifting the left channel input signal;

third phase shifting means coupled to the second input for phase shifting the right channel input signal;

forth phase shifting means also coupled to the second input for phase shifting the right channel input signal;

first summing means having a first input coupled to an output of the first phase shifting means, a second input coupled to an output of the third phase shifting means, and an output for providing a left channel output signal;

second summing means having a first input coupled to an output of the forth phase shifting means, a second input coupled to an output of the second phase shifting means, and an output for providing a right channel output signal;

and wherein for the first and second summing means, a different gain is applied to each different input of the first and second summing means;

and wherein each summing means and each phase shifting means include an operational amplifier.

* * * * *